US006299286B1

(12) United States Patent
Matsumoto et al.

(10) Patent No.: US 6,299,286 B1
(45) Date of Patent: Oct. 9, 2001

(54) METHOD AND APPARATUS FOR FORMING IMAGE WITH COATING OF RECORDING LIQUID AND UNDERCOATING LIQUID

(75) Inventors: Nobuo Matsumoto; Ryoichi Yamamoto; Hideo Ishizaka, all of Kanagawa (JP)

(73) Assignee: Fuji Photo Film, Ltd., Kanagawa (JP)

( * ) Notice: Subject to any disclaimer, the term of this patent is extended or adjusted under 35 U.S.C. 154(b) by 0 days.

(21) Appl. No.: 09/472,977

(22) Filed: Dec. 28, 1999

(30) Foreign Application Priority Data

Dec. 28, 1998 (JP) ..... 10-374662

(51) Int. Cl.[7] ..... B41J 2/21; B41J 2/015
(52) U.S. Cl. ..... 347/43; 347/21
(58) Field of Search ..... 347/43, 20, 21, 347/95, 98

(56) References Cited

U.S. PATENT DOCUMENTS

| | | | | |
|---|---|---|---|---|
| 3,416,153 | | 12/1968 | Hertz et al. | 347/73 |
| 3,946,398 | | 3/1976 | Kyser et al. | 347/70 |
| 4,109,282 | | 8/1978 | Robertson et al. | 358/296 |
| 4,490,728 | | 12/1984 | Vaught et al. | 347/60 |
| 5,646,656 | * | 7/1997 | Leonhardt et al. | 347/43 |
| 6,095,636 | * | 8/2000 | Shioya et al. | 347/43 |

FOREIGN PATENT DOCUMENTS

A63291663 11/1988 (JP) .

* cited by examiner

*Primary Examiner*—Thinh Nguyen
(74) *Attorney, Agent, or Firm*—Birch, Stewart, Kolasch & Birch, LLP

(57) ABSTRACT

A recording liquid which is obtained by changing a proportion of mixture of image forming liquid and clear liquid based on an image signal is transported as a continuous flow to an image receiving medium to form an image. An undercoating liquid is superimposed on the recording liquid at the position where the recording liquid meets the image receiving medium to form a bead so that the recording liquid is loaded on the undercoating liquid. The stream line of the undercoating liquid is bent toward the upstream side in the bead and then turned back toward the downstream side to be straightened. Accordingly, the recording liquid superimposed on the straightened undercoating liquid becomes a stable straightened flow without a sinuosity. The generation of a sinuosity of a stream line of the recording liquid is prevented to improve the image quality. Preferably, a supply amount of the undercoating liquid is set constant. The image forming liquid and the clear liquid may be superimposed in a layer in a direction of the coating thickness to be continuously applied.

27 Claims, 13 Drawing Sheets

METHOD AND APPARATUS FOR FORMING IMAGE WITH COATING OF RECORDING LIQUID AND UNDERCOATING LIQUID

BACKGROUND OF THE INVENTION

1. Field of the Invention

The present invention relates to image an forming method and apparatus for generating recording liquid having a predetermined density and/or a predetermined color by changing a proportion of mixture of image forming liquid and clear liquid based on an image signal and leading the thus-obtained recording liquid to an image receiving medium to form an image.

2. Description of the Related Art U.S. Pat. No. 3,416,153 (which will be referred to as a prior art reference 1, hereinafter) discloses an image forming method, in which a series of charged ink droplets having predetermined intervals is caused to pass through an electric field modulated by an image signal. Unnecessary ink droplets are deflected to be removed and desired ink droplets are selectively guided to a recording sheet so as to form an image on the recording sheet. Since the ink droplets are continuously ejected or jetted in this system, this is referred to as a continuous ink jet system.

U.S. Pat. No. 3,946,398 (which will be referred to as a prior art reference 2, hereinafter) discloses a recording method, in which a piezoelectric transducer plate is deformed by a modulation of an image signal to push out the ink. The pushed-out ink droplets are jetted or expelled from an orifice to be impacted on a recording medium. This system is referred to as a piezo ink jet system.

U.S. Pat. No. 4,490,728 (which will be referred to as a prior art reference 3, hereinafter) discloses another recording method, in which the ink is rapidly expanded or vaporized by heat of a heater modulated by an image signal. The rapidly-expanded ink gas or vapor is used to jet the ink liquid from an orifice to be impacted on a recording medium. Since ink droplets are jetted by using heat, this is referred to as a thermal ink jet system.

U.S. Pat. No. 4,109,282 (which will be referred to as a prior art reference 4) discloses a printing device, in which a valve called a flap valve is provided in a flow path for leading two types of liquid, i.e., clear ink and black ink into a substrate for forming an image. The flow path for each ink is opened/closed by displacement of this valve so that the two types of liquid are mixed in a desired density to be transferred onto the substrate. This enables printout of an image having the gray scale information which is the same with that of the image information displayed on a TV screen.

This reference 4 discloses that a voltage is applied between the flap valve and an electrode provided on a surface opposed to the flap valve and the valve itself is mechanically deformed by the electrostatic attracting force to cause displacement of the valve. Further, the ink is absorbed in paper by a capillary action which acts on the ink between a tip of the flap valve and fibers of the print paper.

Unexamined Japanese Patent Publication (KOKAI) No. 291663/1988 (which will be referred to as a prior art reference 5, hereinafter) discloses a coating method, in which two types of thick (dark) and thin (light) liquid are mixed in a coating head to be continuously extruded from a slot-opening opposed to a running web. Thus, the mixed liquid is consecutively coated on the web. In this coating method, the mixed liquid is coated over the entire coating width with a uniform coating membrane pressure without forming a residue deposit, and the coating liquid having a density graduation in time course is continuously applied with respect to a traveling direction of the web. In addition, this method enables coating with a uniform thickness with respect to the width direction.

According to the method disclosed in the prior art reference 1 (the continuous ink jet system), unnecessary ink droplets are removed by modulating the electric field to enable drawing of a desired image. However, it is required to provide each mechanism for independently modulating the electric field for each nozzle provided for each pixel, thereby making it difficult to reduce the dimension of each nozzle. It is also hard to form multiple nozzles with a high density in accordance with pixels. Only a part of continuously jetted ink droplets must be used for forming an image, and hence this mode is not suitable for high speed recording because many ink droplets are not used but removed. Moreover, since the ink is continuously jetted, a large amount of ink is wasted, and the obtained print is thus expensive.

According to the method disclosed in the prior art reference 2 (the piezo ink jet mode), a desired image can be drawn by jetting only ink droplets which are used for forming an image. Jetting only a necessary amount of ink eliminates the waste of ink, and a relatively-inexpensive print can be obtained. However, the nozzles must be arranged in the high density for realizing the high quality of an image, leading to a problem where the image is distorted by the interaction of the ink droplets jetted from adjacent nozzles.

According to the method disclosed in the prior art reference 3 (the thermal ink jet mode), an arbitrary image can be drawn and jetting only a necessary amount of ink can obtain a relatively-inexpensive print as similar to the above-mentioned piezo ink jet mode. However, when the nozzles are provided in the high density for realizing the high quality of an image, the image is distorted by the interaction of the jetted ink droplets. Additionally, in the above prior art references 1–3, since the droplets are jetted onto image receiving paper at high speed, a part of the ink droplets smashes by impact to form an ink mist. Such ink mist cannot be captured on the image receiving paper. The uncaptured ink mist leaks to the installation environment of the printer to pollute the environment which is pointed out as a problem.

According to the method disclosed in the prior art reference 4, the ink extruded from the nozzle is directly applied on the paper. Therefore, in a case where the paper has a large thickness or irregularity on the surface of the paper, it is difficult to reproduce an image on the paper with fidelity with respect to the electric signal. Accordingly, this method is not done in practical use, as yet. Further, since the ink to be used is restricted to two types, a color image cannot be recorded. Furthermore, since the ink is drawn out by the capillary action between the ink and the fibers of the paper in this mode, the ink tends to be affected by the quality of the paper and a change in quality of the paper involves a change in quality of an image. Moreover, the image cannot be truly reproduced due to the partial irregularity of the fiber structure even if the paper with the same quality is used.

According to the coating method disclosed in the prior art reference 5, although an image having a density graduation along a traveling direction of a web which is a target of coating can be formed, the image cannot have a density graduation along a width direction of the web (a direction orthogonal to the web traveling direction). Consequently, application of the coating liquid whose color or density changes for each pixel in accordance with an image signal is impossible.

In order to solve the above-described problems in the prior art methods, the present inventors have examined the method for transporting the recording liquid as a continuous flow to the image receiving medium. According to this method, the recording liquid is generated in the recording head by maintaining the overall volume flow rate of the image forming liquid and the clear liquid, which is substantially transparent after dried out, substantially constant while changing a proportion of mixture of these types of liquid based on the image signal, and the recording liquid is applied to the image receiving medium as a continuous flow. In this case, it is required for obtaining the excellent image quality to transport the recording liquid extruded or ejected from the extruding port corresponding to each pixel to the image receiving medium in synchronism with the image signal.

On the other hand, when the recording liquid temporarily pools between the recording head and the image receiving medium to form a bead (a liquid bank), a stream line of the recording liquid may become sinuous in the bead. For example, a turbulence of the recording liquid may be generated in the bead. When such a sinuosity of the stream line is produced, the recording liquid cannot be accurately transported to the image receiving medium in synchronism with the image signal, thus resulting in the distortion of an image or deterioration of the image quality.

SUMMARY OF THE INVENTION

The present invention has been accomplished under the circumstances as aforementioned, and a first objective thereof is to provide an image forming method which can prevent generation of a sinuosity or turbulence of a stream line of the recording liquid to improve the image quality when forming an image by transporting recording liquid, which is obtained by changing a proportion of mixture of image forming liquid and clear liquid based on an image signal, to an image receiving medium as a continuous flow. Further, it is a second objective of the present invention to provide an image forming apparatus which is directly used for implementing this method.

According to the present invention, the first objective can be attained by an image forming method for forming an image on an image receiving medium with a recording liquid, comprising the steps of:

providing said recording liquid including an image forming liquid for finally forming the image and a clear liquid which is substantially transparent after dried out, a proportion of the image forming liquid and the clear liquid in the recording liquid being varied based on an image signal; and extruding said recording liquid from each of extruding ports aligned in a recording head to said image receiving medium as a continuous flow while said image receiving medium is moved relatively to the aligned extruding ports so that the recording liquid is continuously applied on said image receiving medium to form the image;

wherein a bead of said recording liquid is formed at a position where said recording liquid comes into contact with said image receiving medium while performing application of said recording liquid; and wherein an undercoating liquid is superimposed on said recording liquid so that the undercoating liquid is positioned on a plane to be brought into contact with the surface of said image receiving medium;

whereby a sinuosity of a stream line of said recording liquid in said bead is prevented while allowing a sinuosity of a stream line of said undercoating liquid in said bead.

According to the present invention, superimposing the undercoating liquid on the recording liquid can generate a stable stream line of the undercoating liquid without a sinuosity in the bead, and the recording liquid is loaded on a stable straight flow of the undercoating liquid to be transported on the image recording medium. When an amount of supply of the undercoating liquid is not subject to modulation using the imaging signal and is maintained constant, the flow of the undercoating liquid can be constantly stabilized to further improve the image quality. The image forming liquid and the clear liquid are not homogeneously mixed but superimposed in a layer in a direction of the coating thickness to be continuously applied. As the undercoating liquid, clear liquid which is substantially transparent or becomes substantially transparent when dried out or achromatic color liquid which has a substantially-achromatic color (for example, white or gray) when dried out is suitable.

When a plurality of recording liquid extruding ports are provided to be aligned in a direction of the width of the image receiving medium so that the undercoating liquid can be from a slot-shaped opening for extruding undercoating liquid which is parallel to a direction of alignment of the recording liquid extruding ports, the undercoating liquid can have a zonal or film-like shape and the stream line thereof can be further stabilized, thereby more improving the image quality. When the recording liquid extruding ports are divided and provided in accordance with respective pixels aligned in a direction of the width of the image receiving medium and the recording liquid extruded from each recording liquid extruding port is integrated in a zonal or film-like form to be superimposed on the undercoating liquid, the recording liquid can be uniformly loaded on the undercoating liquid and a laminar flow of this superimposed layer is stabilized and suitable for improving the image quality.

The density of the pixels of the formed or coated image can be controlled by a proportion or mixing ratio of mixture of the clear liquid and the image forming liquid. Further, colors of the pixels can be controlled by a proportion of mixture of a plurality of types of image forming liquid having different colors. As a property of a plurality of types of liquid to be used, it is preferable that a plurality of types of liquid are laminated or superimposed to be applied in the form of a layer in a direction of the coating thickness, and it is preferable that they have small differences in characteristics at least in viscosity, specific gravity, surface tension and temperature.

The image receiving medium may be an intermediate image receiving medium such as a transfer drum. The intermediate image receiving medium receives and temporarily holds the recording liquid extruded from the extruding ports, and then transfers the recording liquid to a final image receiving medium such as a recording sheet. The image is finally formed or recorded on the final image receiving medium. In this case, since the undercoating liquid is in contact with the surface of the intermediate image receiving medium, the undercoating liquid forms a covering layer to cover the final image formed on the final image receiving medium when transferred to the final image receiving medium.

In addition, a different undercoating liquid may be superimposed so as to be the uppermost layer when applied on the intermediate image receiving medium. When transferred to the final image receiving medium, the undercoating liquid is brought into contact with the surface of the final image receiving medium, thereby suppressing the influence of irregularity of the surface state and the like of the final image receiving medium to improve the image quality. Further, in the case that coating is performed by using the intermediate image receiving medium, arrangements are made so that the coating liquid (including the recording liquid and the undercoating liquid) can smoothly move to the final image receiving medium when the temporary formed image of the intermediate image receiving medium is transferred to the final image receiving medium. For example, adhesion between the intermediate image receiving medium and the undercoating liquid establishing contact therewith or cohesion in the undercoating liquid is so set as to be smaller than cohesion in or between other types of liquid or adhesion between the final image receiving medium and any other liquid establishing contact therewith.

Additionally, if the undercoating liquid is transparent, an image which is faithful to the image signal can be obtained irrespective of existence/absence of the intermediate image receiving medium. When the undercoating liquid which comes into contact with the surface of the final image receiving medium has an achromatic color or a white color, an excellent image can be obtained irrespective of colors of the final image receiving medium. Moreover, in cases where the undercoating liquid covers the surface of a final image when transferred to the final image receiving medium, an image to which an entirely-flat color, e.g., a sepia tone can be obtained is loaded when the undercoating liquid has a desired color.

When adjacent recording liquid extruding ports are biased each other in a direction which is not orthogonal to the relative displacement direction of the image receiving medium, a distance between adjacent pixels can be narrowed to improve the image quality. In this case, addition of compensation to the image signal in accordance with an amount of bias of the adjacent extruding ports can prevent the distortion or deviation of pixels in the recorded image.

The flow of the liquid can be stabilized by always extruding the recording liquid and the undercoating liquid during a period in which no image is formed. The recording liquid which is unnecessary for formation of an image is removed and collected alone or together with the undercoating liquid during the transfer from the recording liquid extruding ports to the image receiving medium.

According to the present invention, the second object can be attained by an image forming apparatus for forming an image on an image receiving medium with a recording liquid, comprising:

a recording head having an array of plural extruding ports aligned in a direction substantially orthogonal to a relative movement direction of the image receiving medium, the respective extruding ports extruding the recording liquid which is a combination of an image forming liquid and a clear liquid, the image forming liquid being for a finally forming the image and the clear liquid being substantially transparent after dried out, the recording liquid being transferred to the image receiving medium as a continuous flow while the image receiving medium is moved relatively to said aligned plural extruding ports;

an opening for extruding an undercoating liquid which is provided in parallel to a direction of arrangement of the array of said extruding head ports in said recording head and superimposes the undercoating liquid on a plane of the recording liquid which comes into contact with the surface of said image receiving medium;

extrusion amount controlling means for controlling supply amounts of said image forming liquid and said clear liquid fed to each of said extruding ports; and a controller for controlling a mixing ratio of the image forming liquid and clear liquid in said recording liquid based on an image signal and determining a supply amount and supply timing of the image forming liquid and the clear liquid, the determined supply amount and supply timing being fed to said extrusion amount controlling means.

The recording liquid extruding port may be provided in accordance with each of the pixels aligned in a direction of the width of the image receiving medium. Or a plurality of recording liquid extruding ports may be provided in a moving direction of the image receiving medium for one pixel so that multiple types of coating liquid having different colors or properties can be supplied from the respective recording liquid extruding ports. The recording liquid extruding ports provided for the multiple pixels and the opening for extruding undercoating liquid may be divided into groups in a direction of the width of the image receiving medium in such a manner that extrusion of the recording liquid and the undercoating liquid from a part of the groups is stopped in accordance with the width of the image receiving medium or the width of an image. In such a case, the wasteful consumption of the recording liquid and the undercoating liquid can be prevented and, when the unnecessary liquid which does not contribute to the coating process is removed and collected, an amount of liquid to be collected can be reduced.

The liquid can be moved from the recording head to the image receiving medium by various kinds of modes. For example, it is possible to adopt a slot coating method by which the recording liquid extruding port and the opening for extruding undercoating liquid are formed on the top surface, the bottom surface or the side surface of the recording head and the image receiving medium is moved along the surface on which the recording liquid extruding port and the opening for extruding undercoating liquid are formed with a predetermined interval or gap being maintained.

Additionally, it is possible to use a slide coating method by which an inclined or sloped surface which inclines toward the image receiving medium is formed on the top surface of the recording head and the recording liquid and the undercoating liquid extruded on the sloped surface flow down on the inclined surface and led to the image receiving medium.

Although the image receiving medium itself may be a final image receiving medium such as print paper, it may be an intermediate image receiving medium. In this case, the intermediate image receiving medium is provided between the recording head and the final image receiving medium and transfers the recording liquid and the undercoating liquid fed from the recording head to the final image receiving medium, and it may have a drum-like shape or a belt-like shape having no end portion.

The extrusion amount controlling means can be formed by a control valve provided in a passage extending from a feed path for supplying the image forming liquid and the clear liquid to the recording liquid extruding port. For example, it may be formed by a diaphragm valve using a piezoelectric device. This extrusion amount control valve is provided for each pixel aligned in a direction of the width of the recording head and controls a quantity of flow by any of or combination of an opening, an opening time and a number of times of opening of the valve. Further, the extrusion amount controlling means may be formed by a pump whose quantity of extrusion is variable. This pump can be constituted by, for example, a piezoelectric device provided for each pixel aligned in a direction of the width of the recording head and a check valve. In this case, a quantity of flow is controlled by any of or combination of an operating speed, an operating time and a number of times of operation of the pump.

The controller determines a proportion of mixture or a quantitative ratio of the image forming liquid and the clear liquid led to each recording liquid extruding port based on an image signal and controls a color or a density of the recording liquid. This mixed or combined liquid (the recording liquid) is ejected or extruded as a continuous flow from the recording liquid extruding port to be moved to the image receiving medium. As a result, an image is formed on the image receiving medium. Since this recording liquid is applied as a continuous flow, the recording liquid is not wasted and a high-quality image can be formed at high speed.

The undercoating liquid supplied from the opening for extruding undercoating liquid is positioned on the upstream side in a bead (liquid bank) generated between the recording head and the image receiving medium. Therefore, a stream line of the undercoating liquid might be bent toward the upstream side and further bent toward the downstream side in the bead. Also, a whirlpool or turbulence might be generated in this bent portion. However, since the image signal is not superposed with respect to the undercoating liquid, occurrence of the temporal sinuosity in a flow of the undercoating liquid does not result in any disadvantage. Since the stream line of the undercoating liquid is bent toward the upstream side and then turned back toward the downstream side to be straightened, a flow of the recording liquid which is superimposed on the straightened undercoating liquid becomes a stable straightened flow without a sinuosity.

In the present invention, the image formed on the image receiving medium includes graphical intelligence patterns such as alphanumeric characters, graphical display, line art, and other image information.

DESCRIPTION OF THE PREFERRED EMBODIMENTS

First Embodiment

An embodiment adopted to a slot coating system is described hereinafter with reference to FIGS. 1 to 5.

Figure 1:
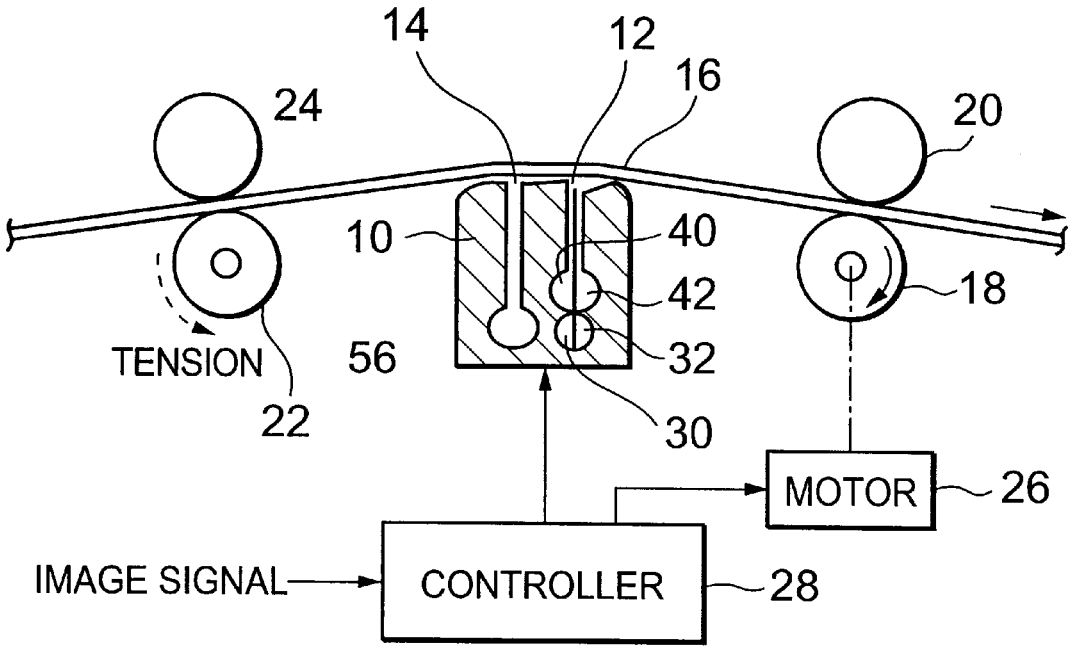
FIG. 1 is schematic diagram showing an image forming apparatus (coating apparatus) according to a first embodiment of the present invention adopting a slot coating method.

In FIG. 1, reference numeral 10 designates a recording head, and this recording head 10 has multiple extruding ports 12 for extruding recording liquid and one slot-shaped opening 14 for extruding undercoating liquid. The ports 12 and the opening 14 are formed on the upper surface of the recording head 10. An image receiving medium 16 constituted by a recording sheet runs to one direction (the right-hand side) on the upper surface of the recording head 10 while the sheet 16 is pushed up by the recording head 10 with a fixed pressure. Reference numeral 18 denotes a driving roller for sandwiching the recording sheet 16 with a driven roller 20 so that the recording sheet 16 is fed to one direction (the right-hand side). Reference numeral 22 is a tension roller which is positioned on the side opposed to the driving roller 18 and the driven roller 20 with the recording head 10 therebetween. The tension roller 22 imparts a fixed tensile force (tension) to the recording sheet 16, which is positioned between the tension roller 22 and a driven roller 24.

Reference numeral 26 represents a driving motor for the driving roller 18, and 28 is a controller. The extruding ports 12 of the recording head 10 are independently provided in accordance with respective pixels in the width direction of the recording sheet 16 (a direction substantially orthogonal to the recording sheet running direction). Each extruding port extrudes the recording liquid constituted by coating liquids, i.e., an image forming liquid and a clear liquid which is substantially transparent after dried out. The mixing ratio of the liquids is controlled based on an image signal. For example, the image forming liquid is black ink and the clear liquid is clear or transparent ink. The density of an image to be recorded can be changed in the multistage (e.g., 256 tones) by varying a proportion or mixing ratio of both types of liquid while maintaining the entire volume flow rate of both types of liquid substantial constant. Keeping substantially constant the entire volume flow rate, the liquid can be continuously transported to the image receiving medium with stable condition. The mixing ratio can be controlled by the controller 28 in the following manner.

Figure 2:
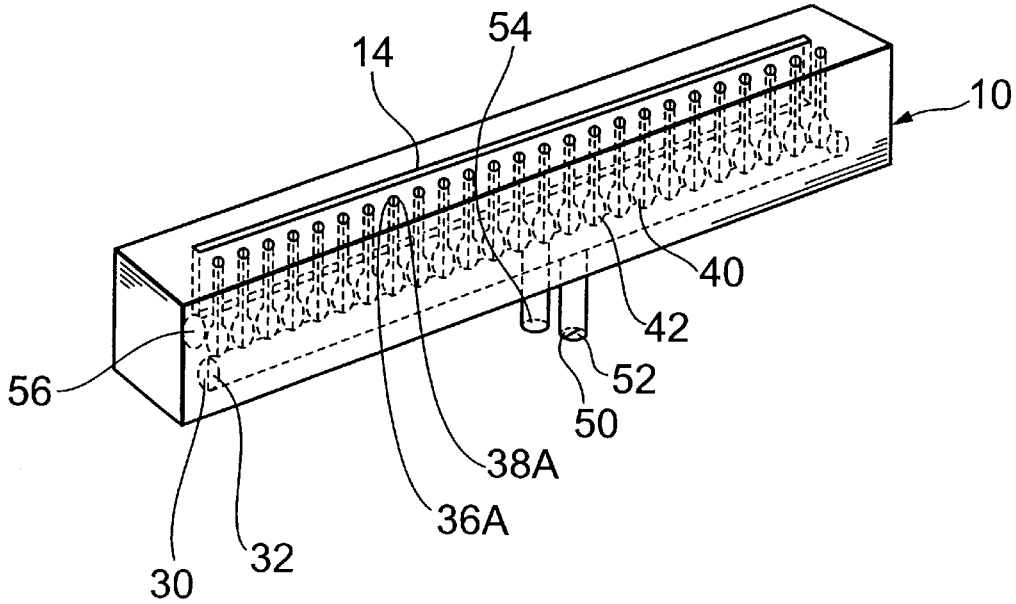
FIG. 2 is a perspective view showing the inner structure of a recording head used in a coating apparatus in FIG. 1.
Figure 3:
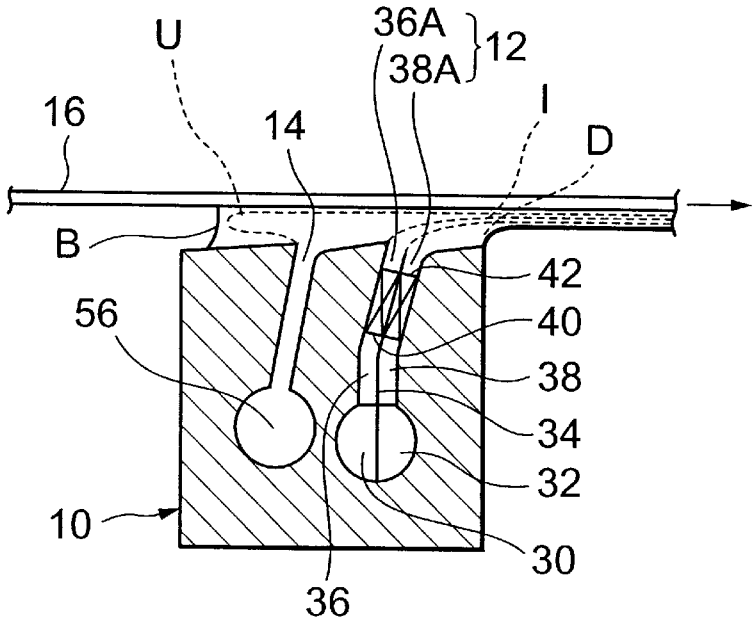
FIG. 3 is an enlarged cross-sectional view showing the recording head in FIG. 2.

In the recording head 10, one feed path 30 for supplying image forming liquid and the other feed path 32 for supplying clear liquid are formed in the width direction of the head as shown in FIG. 3. The inside of each extruding port 12 is divided by a partition 34 into two passages 36, 38 as seen in FIG. 3, and these passages 36, 38 communicates with the feed path 30 for supplying the image forming liquid and the feed path 32 for supplying the clear liquid, respectively. The other ends of the respective passages 36, 38 is outlets 36A, 38A which extrudes the image forming liquid and a clear liquid, respectively (FIG. 2). These outlets 36A, 38A are formed in the extending port 12, so that the coating liquids extruded from the outlets 36A, 38A are combined in the port 12 and extruded from the port 12 as a laminar flow of the combined recording liquid. Further, an image forming liquid extrusion amount control valve 40 and a clear liquid extrusion amount control valve 42 are provided to these passages 36, 38 as coating liquid extrusion amount controlling means.

Figure 4:
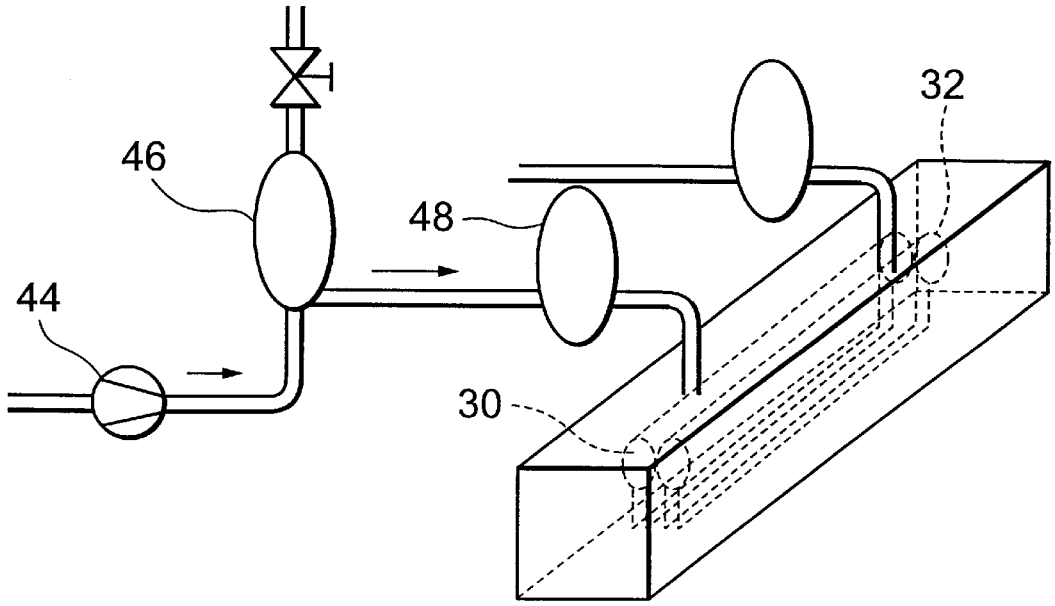
FIG. 4 is a diagram showing a feed path for supplying a coating liquid such as an image forming liquid or a clear liquid.

As shown in FIG. 4, the image forming liquid (ink) is supplied with a fixed pressure from a pump 44 to the feed path 30. In FIG. 4, numeral 46 is a dumper which absorbs pulses of the extrusion pressure of the pump 44 to maintain the extrusion pressure constant. 48 is a filter which removes residue deposits formed or contaminating in the liquid. Similarly, the clear liquid is fed to the feeding path 32 with a constant pressure by the action of not-shown pump, and the structure of the pump and other parts is the same with that of the feeding path 30 for supplying the image forming liquid.

The image forming liquid and the clear liquid are supplied through an image forming liquid supply port 50 and a clear liquid supply port 52 to the feeding paths 30 and 32, respectively.

Similarly, as seen in FIG. 2, the undercoating liquid is supplied from an undercoating liquid supply port 54 to a feed path 56 by a not-shown pump. The feed path 56 for supplying the undercoating liquid is elongated in the width direction of the recording head 10, and the slot-shaped opening 14 communicates with this feed path 56. The slot-shaped opening 14 is positioned on the upstream side of the aligned extruding ports 12 with respect to the running direction of the recording sheet 16 as shown in FIGS. 1 and 3. With such construction, on the surface of the recording sheet 16 is uniformly applied the undercoating liquid and thereafter applied the mixed liquid, i.e., the recording liquid extruded from the extruding port 12.

The extrusion amount control valves 40, 42 may have the same structure. For example, a diaphragm valve driven by a piezoelectric device is suitable. It is to be noted that these control valves 40, 42 or the passages 36, 38 for accommodating these control valves 40, 42 may be produced by a micro-machine manufacturing method to which a technique used in a manufacturing process for a semiconductor device and the like is applied. Although the respective extruding ports 12 are drawn at large intervals in FIG. 2, they are actually provided at extremely-small intervals of pixels.

Figure 5A:
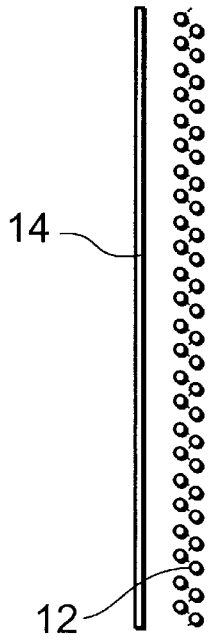
FIGS. 5A and 5B are explanatory views showing examples of arrangement of recording liquid extruding ports provided in the recording head.
Figure 5B:
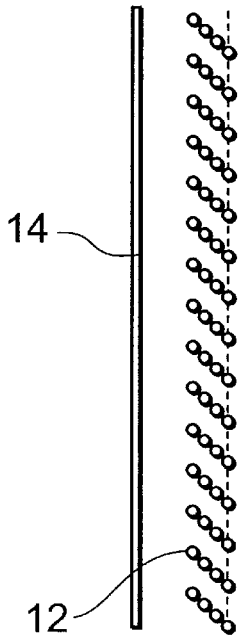

Incidentally, in order to narrow in interval of the coating positions by each extruding ports 12, the adjacent extruding ports 12 may be biased or displaced in the feeding direction of the recording sheet 16 as shown in FIG. 5. FIG. 5A shows that the adjacent extruding ports are alternately biased in the opposed directions and FIG. 5B shows that an appropriate number (e.g., four) of the extruding ports 12 are arranged so as to be sequentially biased in one direction. In FIGS. 5A and 5B, the image receiving medium or recording sheet 16 is fed to the right-hand direction. When biasing each extruding port 12 in this manner, it is needless to say that the controller 28 must change the timing for operating the control valves 40, 42 for different pixels in accordance with a quantity of bias.

According to this embodiment, the controller 28 determines the timing for opening/closing and the ratio of opening/closing time of the control valves 40, 42 so that the relative proportion of the image forming (black) liquid and clear liquid corresponds to the density of each pixel based on an image signal. The determined timing and time period for opening/closing is fed to the respective control valve 40, 42 so that the supply amount and timing of the black and clear liquids are controlled by the control valves 40, 42. As a result, the black liquid and the clear liquid having the controlled amount corresponding to each pixel density are extruded from the respective outlets 36A, 38A into the extruding port 12 to form a composite recording liquid. The recording liquid in the port 12 is extruded from the port 12. On the other hand, a predetermined amount of the undercoating liquid is constantly extruded in the zonal, planate or film-like form the slot opening 14. Therefore, when the recording sheet 16 is moved to a predetermined direction by the motor 26, the undercoating liquid is applied so as to have a uniform in thickness and subjected to surface treatment. The recording liquid having a density determined by mixing ratio of the black and clear liquid is extruded from the extruding port 12 to be applied on the undercoating liquid layer. An image density on the recording sheet 16 varies with a mono-tone graduation by changing the mixing ratio of the black and clear liquids.

A gap size between the recording head 10 and the recording sheet 16 is determined in consideration to a balance of extrusion pressures from the extruding port 12 and the slot opening 14, respectively, and a tension applied to the recording sheet 16. In this gap, the image forming liquid I, the clear liquid D and the undercoating liquid U make a liquid bank, i.e., a bead B (as seen in FIG. 3). In order to form an image which is free from distortion, it is required that the image forming liquid I is orderly and smoothly transferred to the recording sheet 16 without distortion in the bead B.

According to this embodiment, as shown in FIG. 3, a stream line of the undercoating liquid U is bent from the slot opening 14 toward the upstream direction (the left-hand direction) in the bead B and further bent toward the downstream direction (the right-hand direction). Since the undercoating liquid U is transparent, occurrence of turbulence in the stream line of the undercoating liquid in the bead B does not result in any disadvantages. The image forming liquid I and the clear liquid D are so supplied as to be superimposed on the undercoating liquid U which has made a U-turn on the upstream side in the bead B to become a straightened flow. The image forming liquid I and the clear liquid D flow without any turbulence, thereby forming an excellent image.

Further, in this embodiment, the extruding port 12 and the slot opening 14 have the front edge shape formed on the wall surface on the downstream side which is bent along the stream line toward the downstream side (the right-hand side) and have the front edge shape formed on the wall surface on the upstream side which is tapered toward the downstream side. Therefore, any sinuosity or turbulence in the stream line of the recording liquid cannot be observed in particular, and the recording liquid can smoothly flow on the undercoating liquid. In addition, since the clear liquid extruding outlet 38A (FIG. 3) is positioned to be closer to the downstream side than the image forming liquid extruding outlet 36A, the clear liquid D can intervene between the image forming liquid I and the upper surface of the recording head 10. Accordingly, even if the clear liquid D comes into contact with the upper surface of the recording head 10 to generate a delay, the delay of the image forming liquid I is small, further improving the image quality.

In this embodiment, since one type of the image forming liquid and one type of the clear liquid are supplied to each extruding port 12, it is possible to form an image whose density can vary with a single color. However, by using and combining plural image forming liquids having a plurality of colors (e.g., yellow, magenta, cyan, and black) to extrude from a common extruding port, a colored image can be formed or recorded.

Preferably, a decoloration preventing agent is contained in the undercoating liquid, the clear liquid or the image forming liquid in order to avoid deterioration of the recording liquid due to ultraviolet rays or oxidation. As a decoloration preventing agent, there can be used, for example, an antioxidant, an UV absorber or a given kind of metallic complex (e.g., Ni complex). Examples of antioxidants, include chroman-based compounds, coumarane-based compounds, phenol based compounds (e.g., hindered-phenols and the like), hydroquinone derivatives, hindered-amine derivatives, spiroindan-based compounds and others. Moreover, a compound disclosed in Unexamined Japanese Patent Publication (KOKAI) No. 159644/1986 is also effective.

As an UV absorber, there can be used benzotriazol-based compounds (U.S. Pat. No. 3,533,794), 4-thiazolidone-based compounds (U.S. Pat. No. 3,352,681), benzophenone-based compounds (Unexamined Japanese Patent Publication (KOKAI) No. 2784/1981) and other compounds disclosed in Unexamined Japanese Patent Publication (KOKAI) Nos. 48535/1979, 136641/1987, 88256/1986 and others. Further, the UV absorbing polymer disclosed in Unexamined Japanese Patent Publication (KOKAI) No. 260152/1987 is also effective. As a metallic complex, it is possible to employ compounds disclosed in U.S. Pat. Nos. 4,241,155 and 4,245,018, Unexamined Japanese Patent Publication (KOKAI) Nos. 174741/1987 and 88256/1986, Japanese Patent Application Nos. 234103/1987, 31096/1987 and 230596/1987.

An example of the useful decoloration preventing agent is disclosed in Unexamined Japanese Patent Publication (KOKAI) No. 215272/1987. To avoid color deterioration of the pigment transferred to the image receiving material, the decoloration preventing agent may be included in the image receiving medium in advance or it may be supplied from the outside by a method for transferring from a pigment extending material and the like. The antioxidant, the UV absorber and the metallic complex described above may be combined to be used. Additionally, the antioxidant, the UV absorber and the metallic complex described above may be used as an emulsified substance.

Second Embodiment

Figure 6:
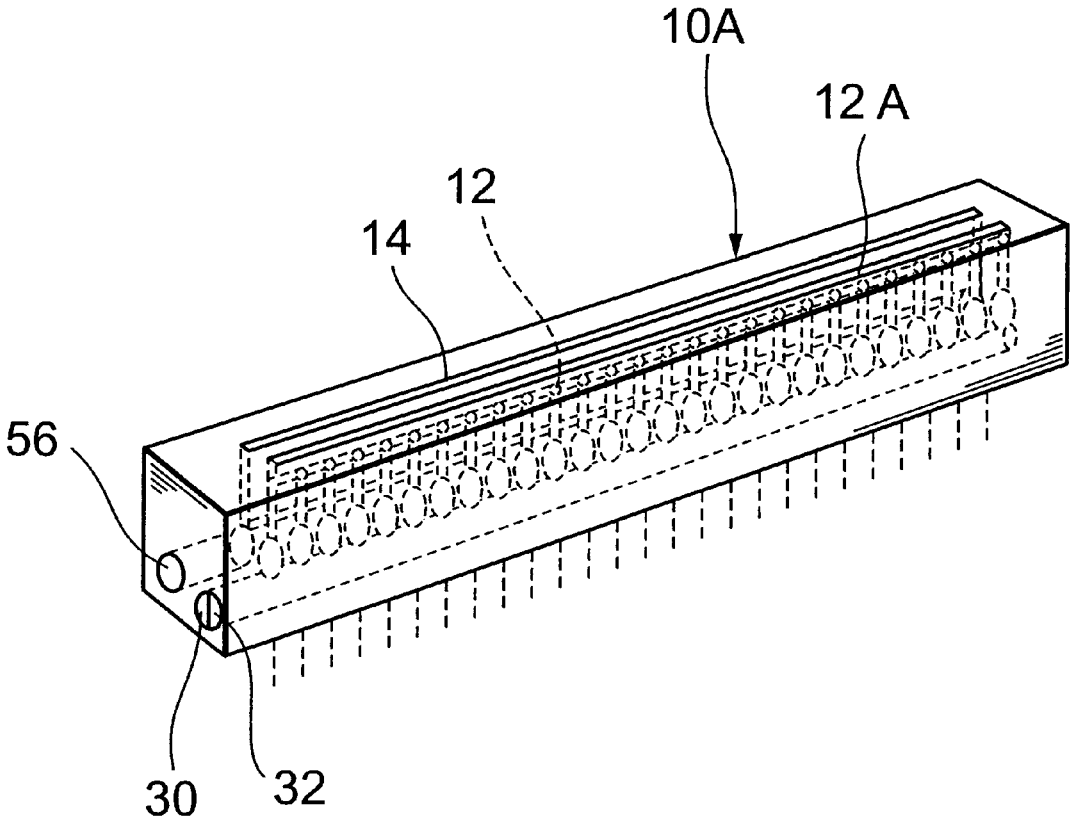
FIG. 6 is a perspective view of a recording head according to a second embodiment of the present invention.

FIG. 6 is a perspective view of a recording head used in an image forming apparatus with coating liquids according to the second embodiment of the invention. The recording head 10A has a slot-shaped opening 12A which is elongated in the width direction of the head 10A and positioned at the downstream side of the extruding ports 12. Specifically, the aligned the extruding ports 12, which has the same construction as those shown in FIG. 2, are opened to the slot-opening 12A.

According to this embodiment, since the recording liquid extruded from the respective ports 12 corresponding to each pixel are continuously gathered and integrated in the slot-shaped opening 12A in the width direction, the laminar flow of liquid is applied in the wide zonal, sheet-like form or film-like form. Coating can be therefore stably performed. Further, superimposition on the undercoating liquid can be stably carried out, which is suitable for improvement in the image quality.

Third Embodiment

Figure 7:
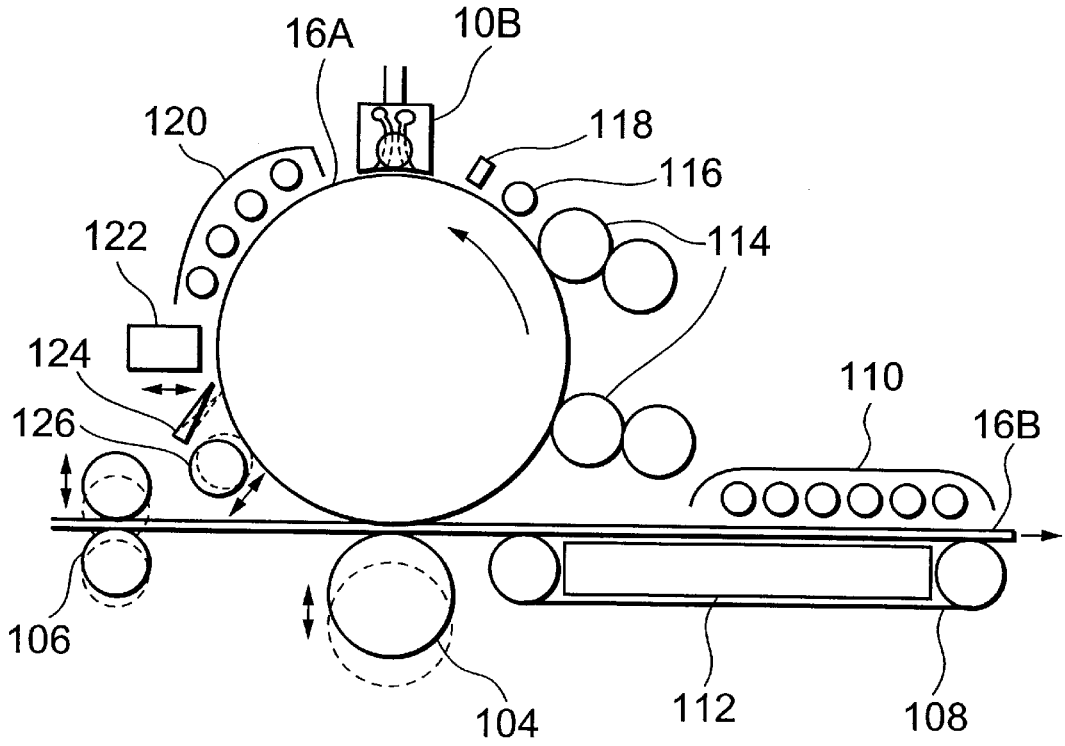
FIG. 7 is an illustrated diagram showing the concept of an image forming apparatus (coating apparatus) according to a third embodiment of the present invention.
Figure 8:
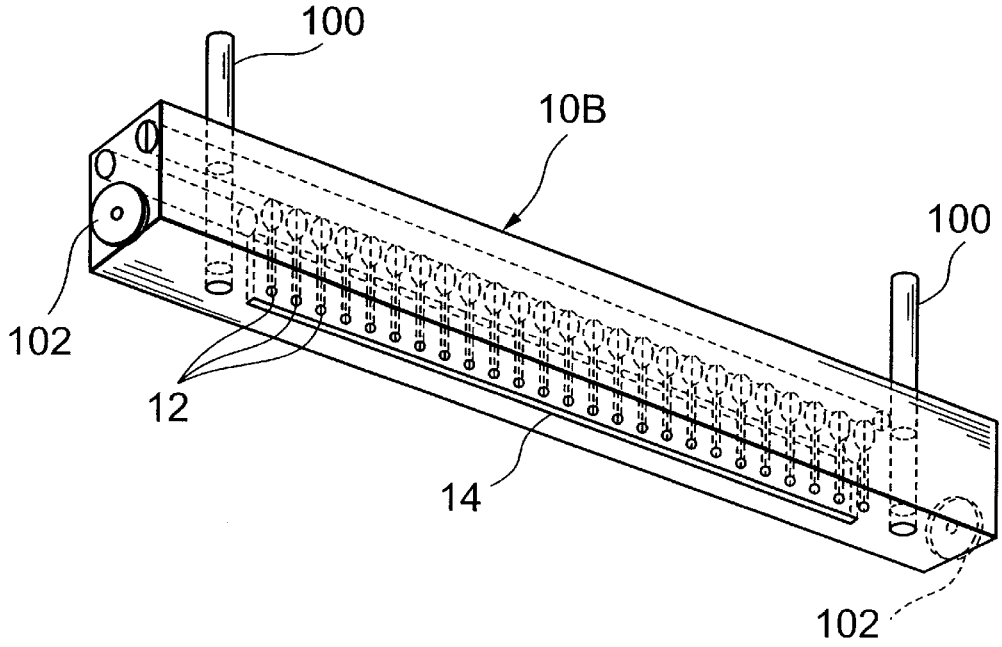
FIG. 8 is a perspective view showing a recording head used in the coating apparatus in FIG. 7.

FIG. 7 is an illustrated diagram showing the concept of an image forming apparatus (coating apparatus) according to a third embodiment of the present invention; FIG. 8, a perspective view showing the inside of a recording head used in this embodiment; and FIG. 9, an explanatory illustration showing the relationship between adhesion and cohesion of each type of applied liquid. This embodiment employes a slot coating method as similar to the foregoing first and second embodiments illustrated in FIGS. 1 to 6, but it is different in that the recording head 10B forms an image on the final image receiving medium 16B through the intermediate image receiving medium 16A.

The intermediate image receiving medium 16A is a cylindrical drum and the recording head 10B supplies the recording liquid I and the undercoating liquid U to the upper periphery of this drum 16A. The recording liquid I is a laminar flow of the image forming liquid and the clear liquid as described above. Since the recording head 10B is constituted as similar to those explained in connection with FIGS. 1 to 5, like reference numerals denote like or corresponding part to omit the tautological description. The recording head 10B is suspended by a pair of guide posts 100 so as to be capable of moving in the vertical direction, and auxiliary rollers 102 provided on the both right and left sides of the recording head 10B. The rollers contact with the both ends of the upper periphery of the drum 16A, thereby maintaining the distance between the recording head 10B and the drum 16A constant.

The recording liquid (layered coating liquids) and the undercoating liquid extruded from the recording head 10B are loaded onto the drum 16A and carried downwards by the counterclockwise rotation of the drum 16A. The final image receiving medium 16B such as recording paper is pushed by a pressure roller 104 against the lower periphery of the drum 16A to travels at the same speed. As a result, the recording liquid and the undercoating liquid on the drum 16A are transferred to the recording paper 16B. The recording paper 16B is fed by a guide roller 106 and a guide belt 108 toward the right-hand side in FIG. 7 at a constant speed, and the recording liquid and the undercoating liquid are dried by a heater 110 in the intermediate position of the feeding path. 112 is a suction box which sucks the recording sheet 16*b* on the upper surface of the guide belt 108 so that the sheet 16B is carried in close contact with the guide belt 108.

Additionally, two cleaning rollers 114, 114 contact with and roll on the drum 16A to clean the surface of the drum 16A. 116 and 118 are a heater and an charged electrode which heat and charge the surface of the drum 16A to carry out the surface treatment for smoothing adhesion of the recording liquid and the undercoating liquid to the rotary drum 16A. 120 and 122 are a heater and an dry air blowing duct for preliminarily drying the recording liquids and the undercoating liquid supplied from the recording head 10B.

Reference numeral 124 denotes a blade for collecting liquid which can serve as coating liquid collecting means. This blade 124 strips off and collects the liquid which is unnecessary for the image formation from the transfer drum 16A. Incidentally, since the state of application of the recording liquid and the undercoating liquid can be stabilized by constantly extruding them from the recording head 10B, the image formation can be stabilized by constantly supplying the liquid while removing the unnecessary liquid by using this blade 124. 126 is a cleaning roller for further cleaning the surface of the drum 16A from which the unnecessary liquid has been removed by the blade 124.

As shown in FIG. 8, the undercoating liquid extruding slot 14 is provided at the upstream side of the recording liquid extruding ports 12. That is, the surface or the drum 16A travels from the left-hand side to the right-hand side in FIG. 8. Accordingly, the recording liquid is superimposed on the undercoating liquid which has been transferred onto the drum 16A. When the superimposed layers of the undercoating liquid and the recording liquid is transferred to the drum 16A, the undercoating liquid is brought into contact with the surface of drum 16A, thereby stabilizing a flow of the recording liquid to improve the image quality without any distortion.

Figure 9:
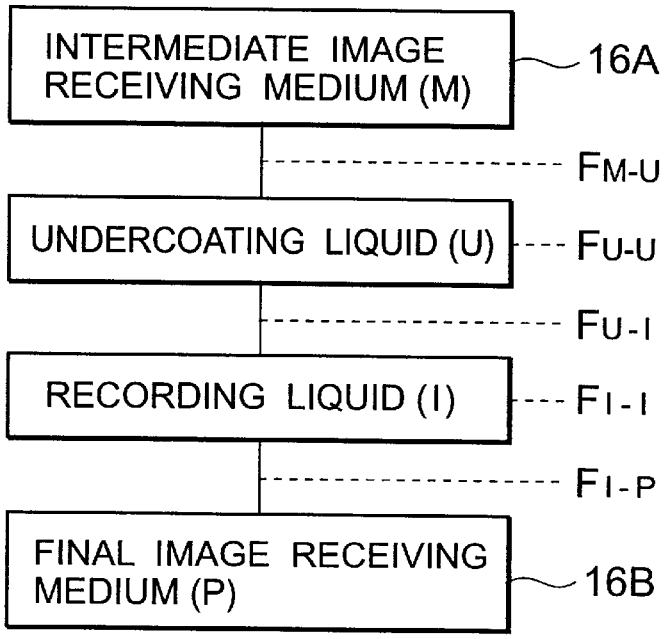
FIG. 9 is an explanatory illustration showing the relationship between adhesion and cohesion of each type of applied liquid.

The following conditions are required for the smooth transfer of the undercoating liquid and the recording liquid applied to the drum 16A onto the recording paper 16B. FIG. 9 is an explanatory illustration showing each layer and the relationship between the adhesion of the liquid and the cohesion in the liquid in such a case. In the figure, it is assumed that the intermediate image receiving medium or drum 16A is represented as M; the undercoating liquid, U; the recording liquid, I; the final image receiving medium 16B, P; the adhesion acting between these members, $F_{M-U}$, $F_{U-I}$ and $F_{I-P}$; and the cohesion in the undercoating liquid and the recording liquid, $F_{U-U}$ and $F_{I-I}$. Here, each type of liquid and the state of the surface of the receiving mediums 16A and 16B are set in such a manner that $F_{M-U}$ becomes minimum.

Here, the recording liquid may be obtained by homogeneously mixing the image forming liquid and the clear liquid. For example, the mixture can be obtained by providing a static mixer having a honey-comb shape or a pipe-like spiral shape for agitating the liquid in the extruding ports 12. Further, if the image forming liquid and the clear liquid are not mixed but separately superimposed in a layer, adhesion between respective layers or cohesion in each layer is classified and adhesion between the intermediate image receiving medium (16A) and the liquid coherent thereto may be minimized as similar to the above.

Fourth Embodiment

Figure 10:
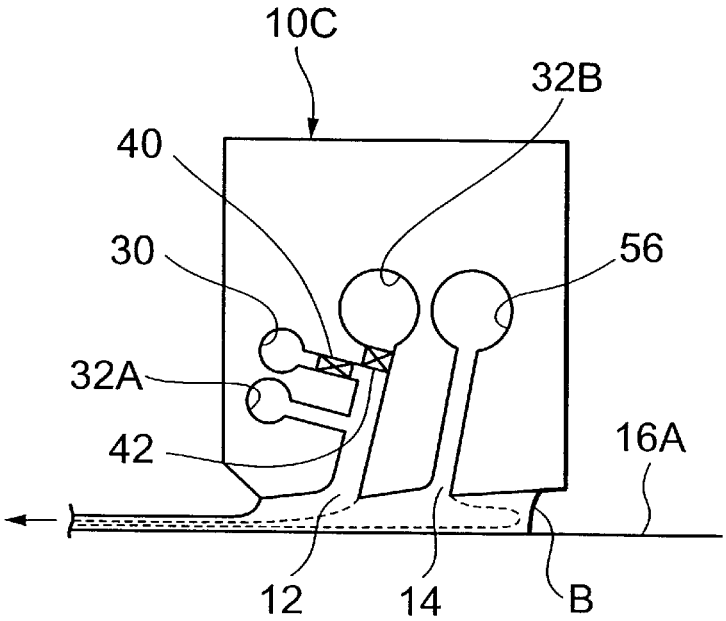
FIG. 10 is a cross-sectional view showing a recording head used in a coating apparatus according to a fourth embodiment of the present invention.

FIG. 10 is a cross-sectional view showing a recording head used in a coating apparatus according to a fourth embodiment of the present invention. The recording head 10C is used in the slot coating method similar to that illustrated in FIG. 7, and an amount of the image forming liquid supplied from the feed path 30 is controlled by a control valve 40. Further, the clear liquid is divided into two layers and supplied so as to sandwich the image forming liquid from the both sides. More specifically, one feed path 32A constantly extrudes a fixed amount of the clear liquid and an amount of the clear liquid extruded from the other feed path 32B is varied by the control valve 42. At this time, the two clear liquids and the image forming quid are controlled in such a manner that their total volume flow rate becomes substantially constant. Therefore, the overall amount of the recording liquid extruded from the port 12 becomes a fixed value, thereby enabling the stable coating.

Here, since it can be considered that the clear liquid supplied from the feed paths 32A and 32B and the image forming liquid supplied from the feed path 30 have a substantially-fixed fluid pressure, the total flow rate of these types of liquid is nearly determined by a cross sectional area of a flow path of the feed path for supplying clear liquid 32A on the downstream side. Therefore, a flow rate of the clear liquid extruded from the feed path 32A increases or decreases in accordance with rise and fall of a total flow rate of other types of coating liquid, i.e., a total flow rate of the clear liquid supplied from the feed path 32B and the image forming liquid supplied from the feed path 30. Therefore, the extrusion amount control valve is not necessary in the flow passage of one feed path for supplying clear liquid 32A, thereby simplifying the structure of the recording head 10C.

Further, the undercoating liquid extruding slot 14 is formed at the position in the upstream side of the coating liquid extruding port 12. Thus, the stream line of the undercoating liquid which is constantly supplied by a predetermined amount from the feed path 56 may be bent toward the upstream side in the bead B according to circumstances, but the coating liquid (recording liquid) having the three-layer structure in which the image forming liquid is sandwiched by the two clear liquid layers from the both sides is superimposed on the stable undercoating liquid and then supplied. Therefore, the distortion is not generated in an image. Additionally, since the image forming liquid is sandwiched by the two clear liquid layers from the both side, the clear liquid directly comes into contact with the inner wall surface of the extruding port 12, and the flow of the image forming liquid is smoothed to further improve the image quality.

Fifth Embodiment

Figure 11:
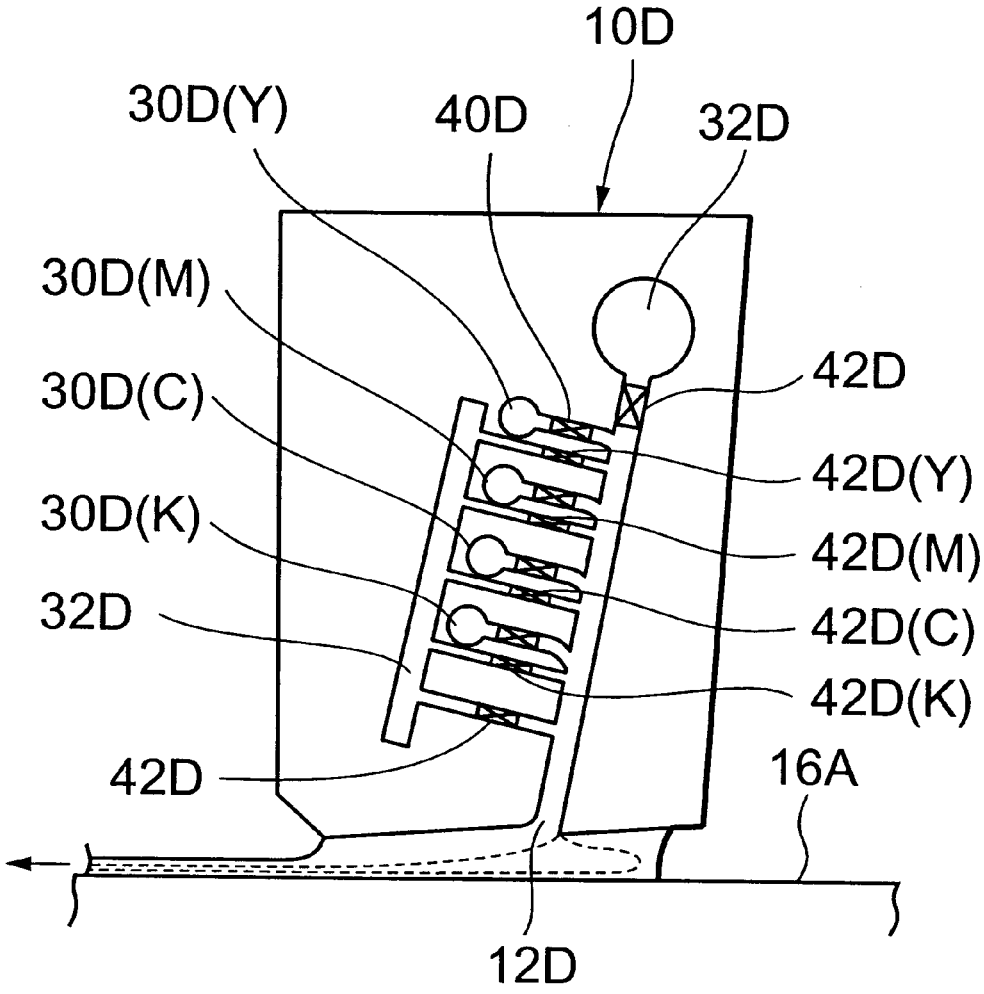
FIG. 11 is a cross-sectional view showing a recording head used in a fifth embodiment.
Figure 12:
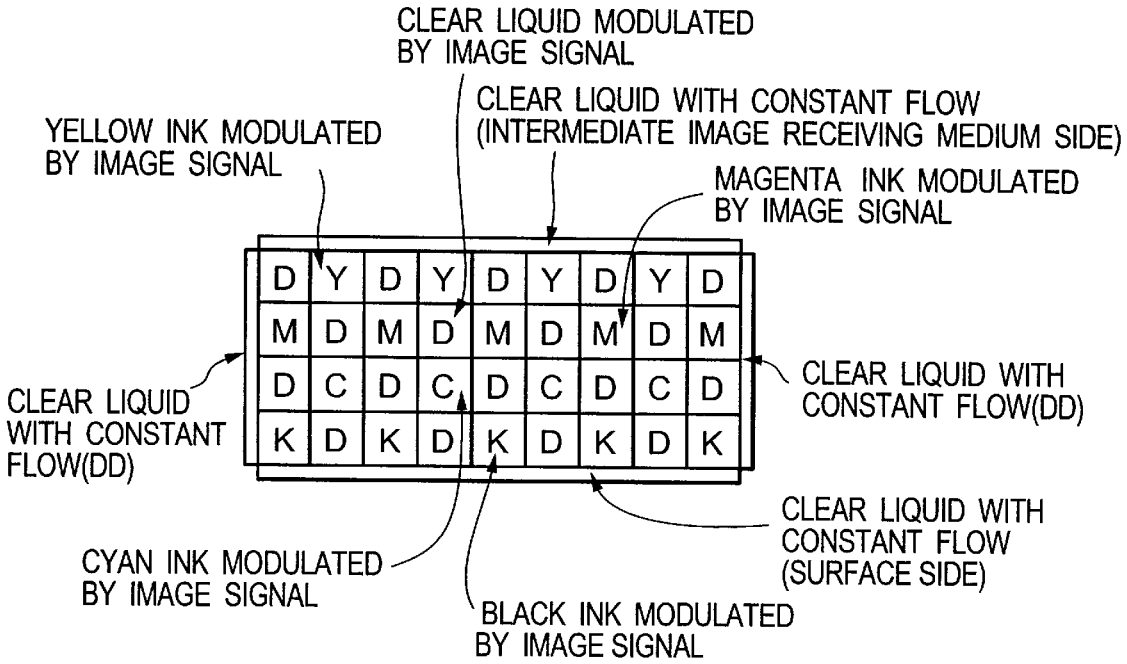
FIG. 12 is a cross-sectional view typically showing the superimposed structure of the combined coating liquids applied onto an intermediate image receiving medium by the recording head in FIG. 11.

FIG. 11 is a cross-sectional view of a recording head 10D used in to a fifth embodiment; and FIG. 12 is a cross-sectional view for typically showing the superimposed layer structure of the coating liquid (recording liquid) applied by the recording head 10D. This recording head 10D is used for forming a color image by the above-mentioned slot coating method.

The recording head 10D includes feeding paths 30D(Y), 30D(M), 30D(C) and 30D(K) for supplying image forming liquid having four colors, i.e., yellow (Y), magenta (M), cyan (C) and black (K); four control valves 40D provided in respective passages communicating with the extruding ports 12D, for controlling each amount of extrusion of the image forming liquid; two feed paths 32(D) for supplying the clear liquid (D) between the image forming liquids having the respective colors and to the both surfaces of the liquid layer; control valves 42D(Y), 42D(M), 42D(C) and 42D(K) for controlling an amount of the clear liquid to be supplied in the vicinity of the respective types of image forming liquid; and two control valves 42D for controlling an amount of clear liquid supplied to the both surfaces of the superimposed layer. Here, when an amount of supply of the image forming liquid is changed, the amount of supply of the clear liquid (D) flowing between the respective types of the image forming liquid having the different colors is also changed in reverse proportion to the change of supply amount of the image forming liquid, whereby the clear liquid has a function for maintaining the thickness of the superimposed layer substantially constant. Moreover, it is determined that the clear liquid that covers the both sides of the superimposed layer has a fixed amount of flow irrespective of the image signal.

The cross-sectional structure of this superimposed layer is as shown in FIG. 12. In this figure, reference characters Y, M, C and K represent the image forming or recording liquid (ink) having respective colors and their amounts of supply are modulated based on the image signal. As shown in FIG. 11, when the image forming liquids having respective colors (Y, M, C and K) are superimposed in the order of Y, M, C and K from the side closer to the intermediate image receiving medium 16A, the upper surface of the superimposed layer in FIG. 12 is positioned to oppose the intermediate image receiving medium 16A. Although the two types of image forming liquid that have two colors are superimposed in the thickness direction of the coating membrane in the superimposed layer, it is needless to say that the clear liquid (D) may be supplied in place of all the types of the image forming liquid to provide transparency (non-color) or two or more colors (three or four colors) may be mixed.

The top surface (the free surface side) and the bottom surface (the intermediate image receiving medium side) of the superimposed layer are covered with the clear liquid (D) respectively. In this case, the clear liquid (D) positioned at the intermediate receiving medium side serves the function of the under coating liquid (U) and has a stream line which is bent toward the upstream side in the bead (B), but the recording liquid (I) is positioned to be closer to the downstream line is stabilized without a sinuosity. The control valve 42D may be controlled by the image signal so as to adjust the amounts of the clear liquid. In this case, the clear liquid supplied to the vicinity of each opening of the feed paths for supplying image forming liquid functions to prevent the respective types of the image forming liquid from adhering to the inner wall of the recording heads. Another type of clear liquid (DD) having constant flow rate may be applied to the superimposed layer on the both end surfaces thereof in the width direction. In this case, another feed path for supplying the clear liquid (DD) may be added to the recording head 10D.

In this embodiment, since the image forming liquid having the respective colors (Y, M, C and K) and the clear liquid constitute a laminar flow and are orderly applied in the form of a layer and they are not mixed with each other in the superimposed layer, a streaky irregularity which corresponds to each color in each pixel can be recognized in an image which is formed and dried in the final image receiving medium 16B. In order to remove such an irregularity, the image forming liquid is mixed with the clear liquid immediately before the extruding ports 12 for respective pixels. Thus, it is preferable to provide, e.g., a so-called static mixer having a thin honey-comb shape or a pipe-like spiral shape in the middle of the passage for the mixed liquid.

Sixth Embodiment

Figure 13:
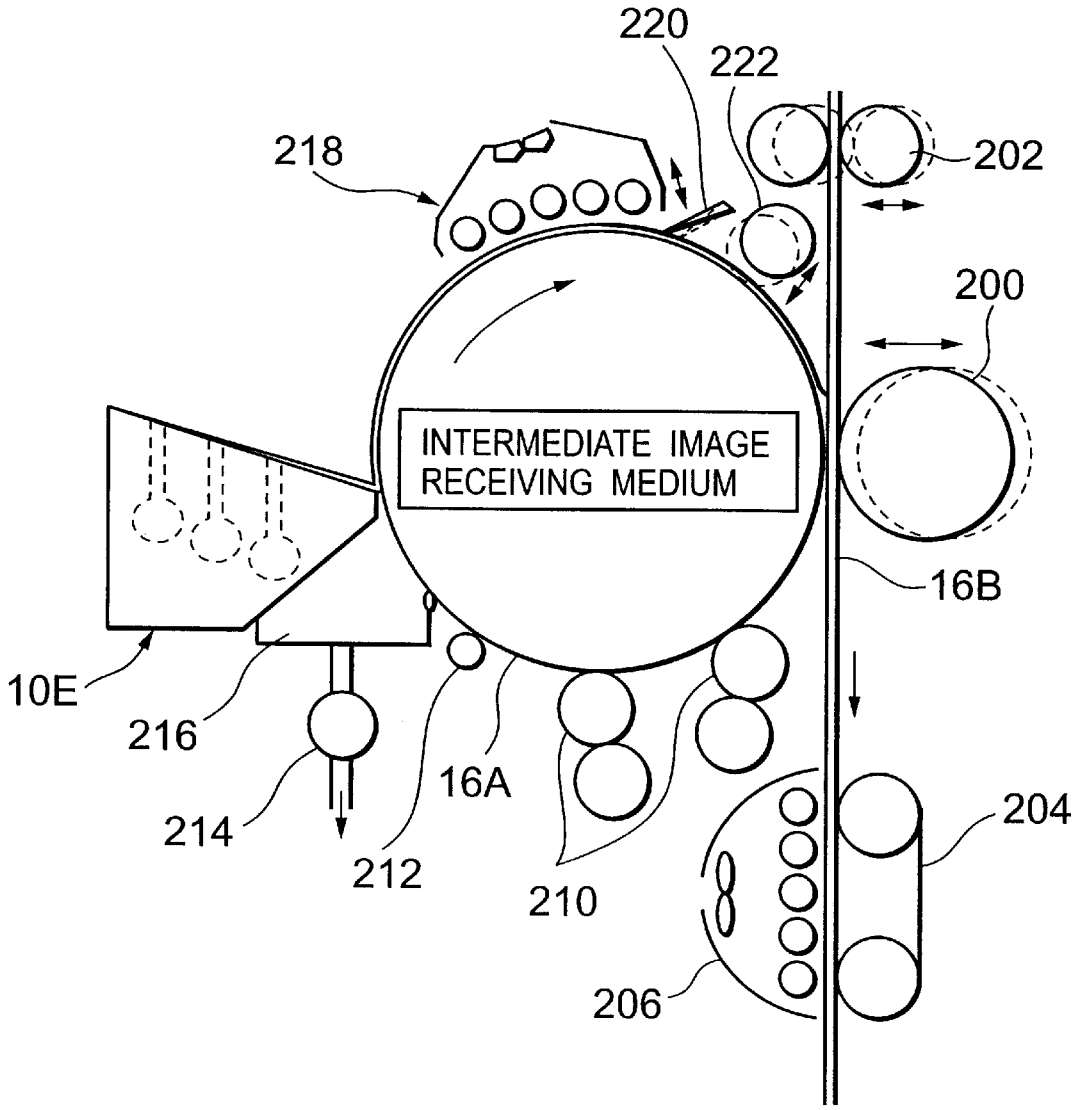
FIG. 13 is an illustrated diagram showing a coating apparatus adopting a slide coating method according to a sixth embodiment of the present invention.
Figure 14:
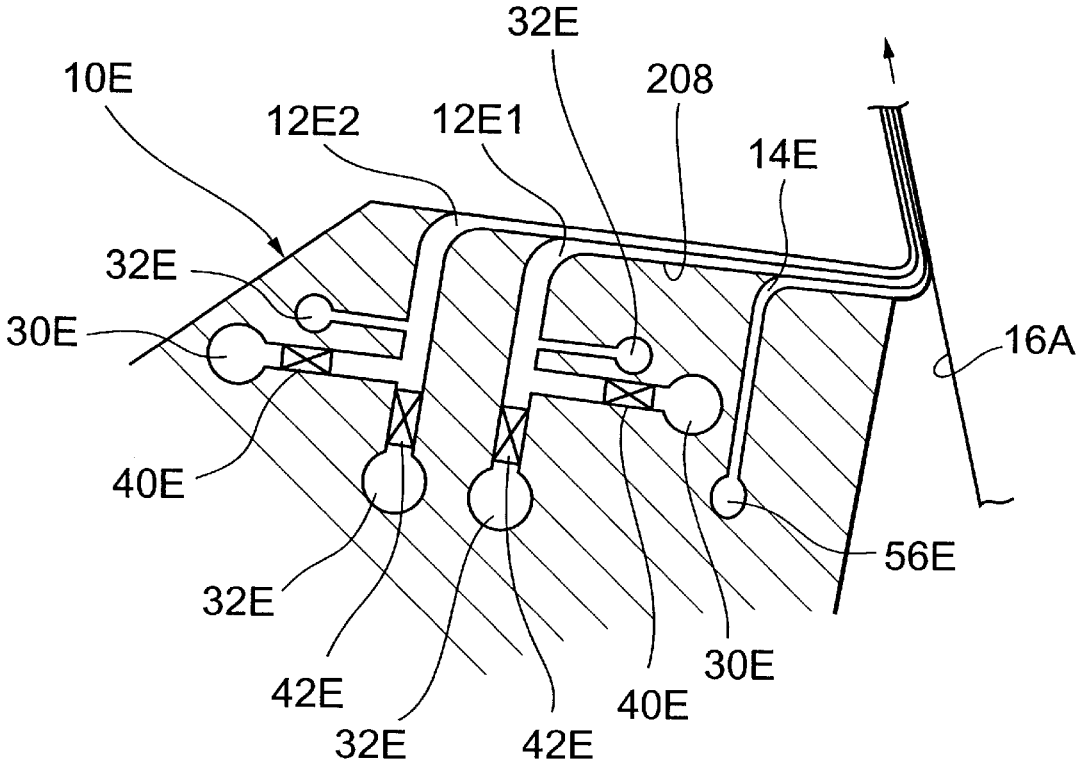
FIG. 14 is a cross-sectional view showing the recording head used in the coating apparatus in FIG. 13.
Figure 15:
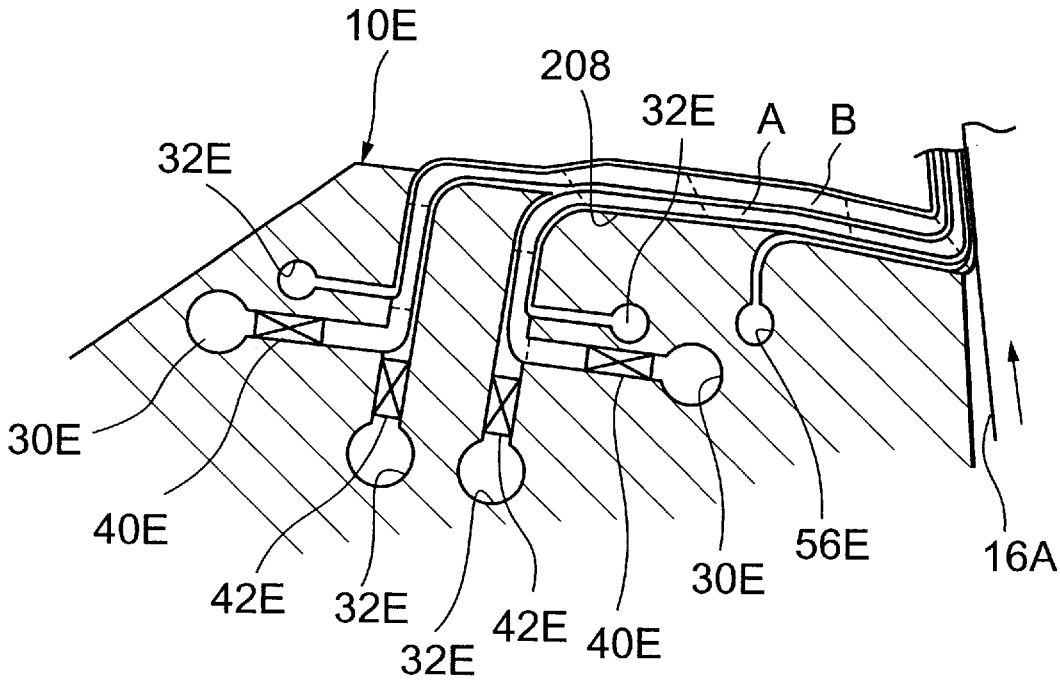
FIG. 15 is a view showing the layer structure of the combined and laminar coating liquids which flows on a sloped top surface of the recording head in FIG. 14.

FIG. 13 is a view schematically showing a coating apparatus according to a sixth embodiment; FIG. 14 is a cross-sectional view showing a recording head used in the coating apparatus; and FIG. 15 is a view showing a layer structure of the coating liquid (the recording liquid). This embodiment shows a coating apparatus adopting a slide coating mode.

Reference numeral 10E denotes a recording head which is provided on one side (the left-hand side) of the intermediate image receiving medium, i.e., a rotary transfer drum 16A. The recording head 10A supplys the coating liquid (the recording liquid) to the drum 16A from this position. On the other side (the right-hand side) of the drum 16A, the final image receiving medium, i.e., recording sheet 16B is pressed by a pressure roller 200, and the coating liquid (the recording liquid and the undercoating liquid) is transferred to the recording paper 16B from the surface of the drum 16A at this position. Here, the recording sheet 16B is substantially-vertically fed downwards by a guide roller 202 and a guide belt 204 and dried out by a heater 206 at the intermediate position in the travelling path of the sheet 16B.

As shown in FIG. 14, the recording head 10E has an sloped surface 208 on the upper surface thereof. This sloped surface 208 inclines downwards to the intermediate image receiving medium or drum 16A and the lower edge thereof is horizontal to the width direction and neighboring to the drum 16A. On this inclined surface 208 are formed an opening 14E for extruding undercoating liquid, a first recording liquid extruding port 12E1 and a second recording liquid extruding port 12E2 from the lower edge in the mentioned order. It is to be noted that the opening 14E for extruding undercoating liquid has a slot shape which is continuous in the width direction and the first and second extruding ports 12E1, 12E2 are separately provided for each pixel.

The undercoating liquid used herein is supplied from a feed path 56E and its adhesion with respect to the drum 16A or the cohesion in the undercoating liquid is so set as to be smaller than the adhesion or cohesion of any other type of image forming liquid or clear liquid. In addition, to the extruding ports 12E1, 12E2 are extruded the coating liquid (the recording liquid) which has a three-layer structure in which two types of image forming liquid A and B whose amount of extrusion is controlled by the control valve 40E are sandwiched by the clear liquid from the both sides. Reference numeral 30E denotes each feed path for supplying image forming liquid (A, B); and 32E, a feed path for supplying clear liquid which is fed to the both sides of each type of the image forming liquid (A, B). Further, reference numeral 42E designates a control valve for controlling an amount of one of two types of the clear liquid supplied to the respective extruding ports 12E1, 12E2.

According to this embodiment, as shown in FIG. 15, the respective types of image forming liquid A and B orderly flow down on the sloped surface 208 in the form of a laminar flow in which the image forming liquid is sandwiched between the clear liquid and are transported to the intermediate image receiving medium 16A. The supply amount of the respective types of image forming liquid A and B is controlled in accordance with the image signal. Also, the operation timings of the respective control valves 40E and 42E are compensated in such a manner that these types of image forming liquid A and B are controlled to become in phase with each other on the intermediate image receiving medium 16A. Further, since the undercoating liquid is positioned in the lowest layer, the recording liquid is loaded on the straightened stable undercoating liquid even if a flow of the intermediate image receiving medium 16A becomes sinuous, resulting in no distortion of an image.

In FIG. 13, reference numeral 210 represents each cleaning roller, and 212 is a heater. These members carry out preliminary treatment of the surface of the intermediate image receiving medium or drum 16A to improve the wettability of the liquid. Reference numeral 214 designates an exhaust pump; and 216, a suction chamber. The suction chamber 216 faces to the vicinity of the coating liquid (which includes the recording liquid and the undercoating liquid) moving portion between the recording head 10E and the drum 16A from the lower side and prevents the air from entering between the undercoating liquid and the drum 16A so as to avoid the distortion of the image due to the air contamination. 218 is a heater for preliminarily drying the applied liquid. 220 is a blade as coating liquid collecting means and 222 is a cleaning roller. These members 220, 222 remove and collect the coating liquid which is unnecessary for image formation, e.g., the unnecessary coating liquid existing on the front edge side or rear edge side of the image.

Seventh Embodiment

Figure 16:
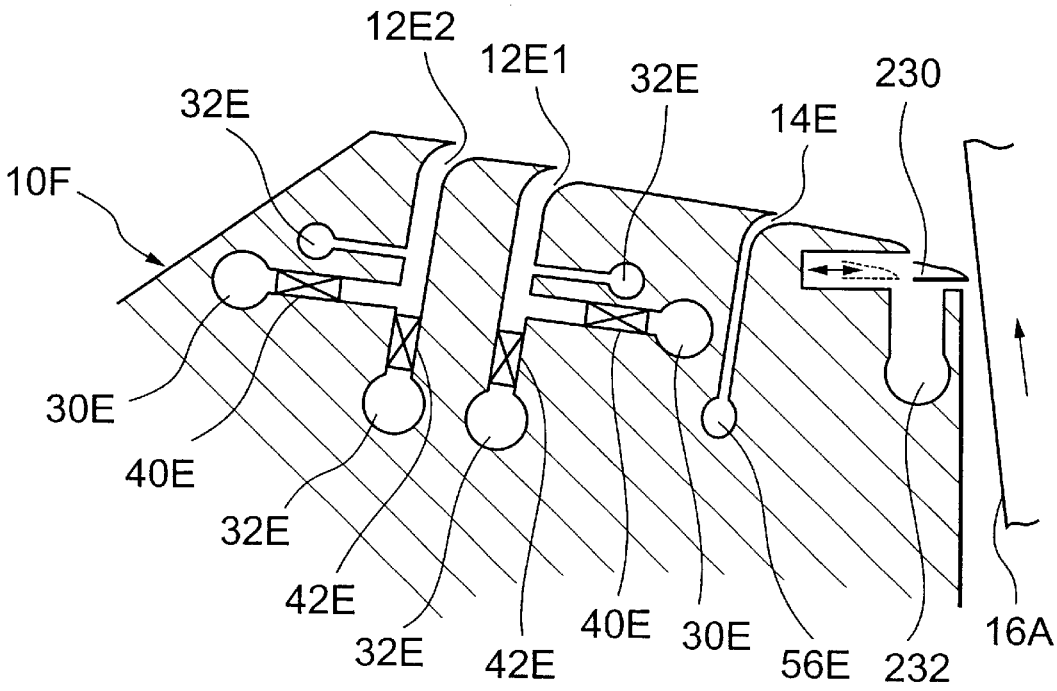
FIG. 16 is a cross-sectional view showing the recording head used in a coating apparatus according to a seventh embodiment of the present invention.

FIG. 16 is a cross-sectional view of a recording head 10F used in a coating apparatus according to a seventh embodiment. The recording head 10F is used for the slide coating mode similar to that illustrated in FIG. 13, and like reference numerals denote parts similar to those in the recording head 10E depicted in FIGS. 14, 15, thereby omitting tautological explanation. As different from the recording head 10E shown in FIGS. 14, 15, a collection switching plate 230 and a coating liquid collecting path 232 as coating liquid collecting means are added to the sloped surface 208.

During the normal operation of the image formation, the collection switching plate 230 moves forwards to close the collection path 232 and loads the coating liquid (recording liquid and undercoating liquid) on the upper surface thereof so that the coating liquid is caused to flow downwards, thereby leading the coating liquid to the drum 16A. The coating liquid which is unnecessary before and after the image formation is led to the coating liquid collection path 232 by opening the collection switching plate 230. In this manner, before applying the coating liquid to the drum 16A, the collection switching plate 230 is opened to make collection possible, thereby enabling the coating liquid collecting operation with the good responsibility. Further, the structure is simplified to be suitable for downsizing.

Incidentally, when forming a final image whose width is smaller than an effective recording width of the recording head 10F, it is satisfactory to extrude the coating liquid (the image forming liquid, the clear liquid and the undercoating liquid) for the necessary width. Therefore, it is desirable to selectively extrude the liquid from only the portion corresponding to the width of the recording area of the final image by closing the control valve so as not to extrude the unnecessary liquid from the extruding ports. Additionally, the openings for extruding clear liquid and/or undercoating liquid are grouped into a plurality of extrusion blocks in the width direction so as to extrude the liquid only in the block corresponding to the recording area of the image. By doing so, the load of the blade 220 (see FIG. 13) or the collection switching plate 230 for removing/collecting the unnecessary liquid can be reduced and the burden of cleaning the image receiving medium 16A can be also decreased.

Eighth Embodiment

Figure 17:
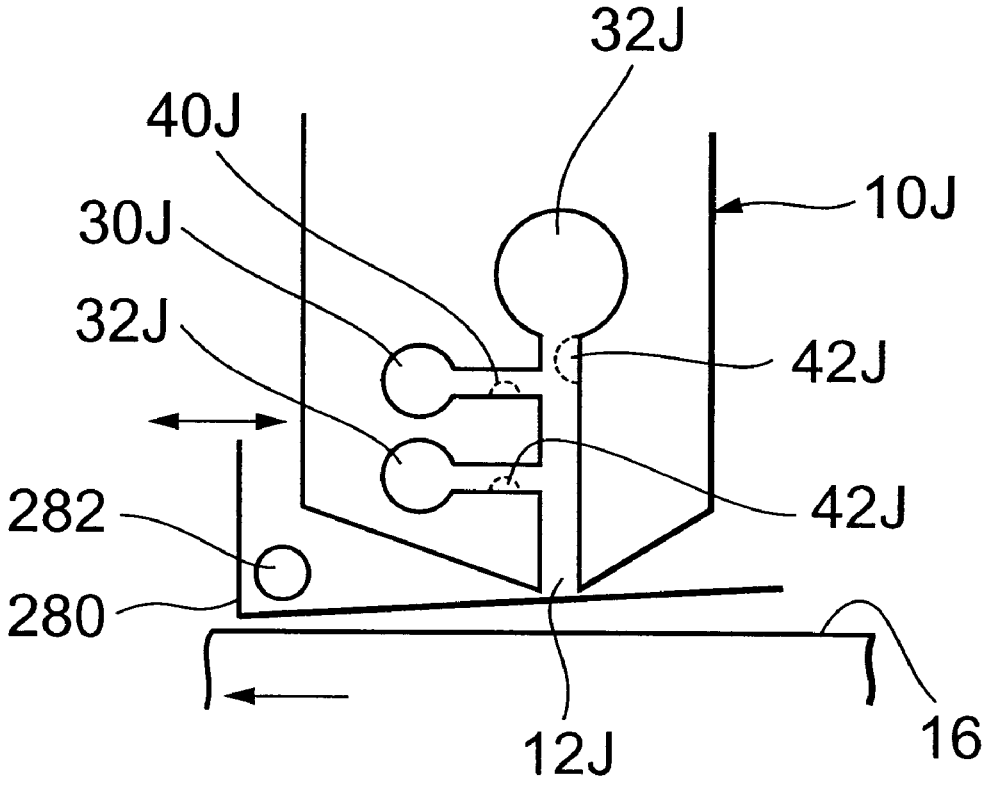
FIG. 17 is a cross sectional view showing a recording head according to an eighth embodiment of the invention.

FIG. 17 is a cross-sectional view showing a recording head according to an eighth embodiment. This recording head 10J includes aligned recording liquid extruding ports 12J which are opened in the downward direction. The final image receiving medium (the recording sheet) 16 is contiguous to the lower portion of the array of the extruding ports 12J and fed at predetermined intervals. A switching plate 280 as coating liquid collecting means is retractably provided between the array of the extruding ports 12J and the recording sheet 16.

That is, the collection switching plate 280 is elongated in the width direction of the recording head 10J, and its one edge entering under the aligned extruding ports 12J has a thin plate shape while the other edge is upwardly bent in the form of L. Further, the top surface of the switching plate 280 is downwardly inclined from the plate edge to the L-shaped bent portion. In addition, a coating liquid suction opening 282 which extends in the width direction of the recording head 10J is formed to the inner side of the L-shaped bent portion.

Therefore, when the plate end of the collection switching plate 280 is caused to enter under the extruding ports 12J, the recording liquid extruded from the respective ports 12J flows toward the L-shaped bent portion on the collection switching plate 280. The recording liquid is then sucked from the suction opening 282 to be removed and collected. When the collection switching plate 280 is recessed from the lower side of the extruding ports 12J, the recording liquid extruded from the ports 12J is applied onto the recording sheet 16 to form an image.

Other Embodiments

When the recording head is not used for a long time, evaporation of the solvent in the liquid causes deposition and precipitation hardening of the solute. Consequently, there occurs such a problem as that the formed residue deposite clots the extruding port and the feed path of the liquid in the recording head. In order to avoid this problem, it is desirable to flush a cleaning liquid for cleaning the recording head upon completing the use. Further, when the recording head is not used, a large advantage can be obtained by putting a cover on the surface of the recording head (the sloped surface in particular) to prevent the liquid from being in contact with the outside air. Although liquid for dissolving solid components contained in the coating liquid is desirable as the cleaning liquid, it is possible to impart this function to the undercoating liquid or the clear liquid which become substantially transparent after dried out.

It is effective for the uniform coating to control so as to equally set a temperature of the coating liquid such as the image forming liquid, the clear liquid or the undercoating liquid, a temperature of the recording head and an environmental temperature on the periphery of the recording head. In a case that the slot coating mode is employed, it is effective for the uniform coating to set a temperature of the intermediate or final image receiving medium to be equal to a temperature of the coating liquid or the recording head. When replacing the coating liquid during the operation, it is preferable to provide a heat exchanging portion in a coating liquid storage tank or in the middle part of a coating liquid supplying channel in such a manner that the coating liquid can have a predetermined temperature before reaching the recording head.

The above embodiment has been described with regard to the formation of the image. That is to say, the technique of two-dimensionally drawing the image on a paper or a film has been described. However, the present invention can be applied to the manufacture of a mosaic filter for use in an image display such as a liquid crystal color display, that is to say, a color filter in which the colors of yellow, magenta and cyan are arranged in a mosaic pattern. In addition, the present invention can also be applied to the manufacture of an industrial product for forming a spatially repeated pattern.

As described above, according to the present image forming method, a plurality of types of coating liquid as a continuous flow from a plurality of recording liquid extruding ports which are aligned in a direction (the width direction) substantially orthogonal to a relative movement direction of the image receiving medium to continuously apply the recording liquid to the image receiving medium. therefore, the highspeed image formation is enabled with a reduced amount of ink to be wasted. Since formation of the electric field which differs in accordance with each pixel is not necessary, the dimension of the extruding nozzle can be reduced. The distortion of the image is not generated due to interaction between the ink droplets such as that observed in the ink jet mode or any adverse effect is not caused in the installation environment, thus reducing the influence of the thickness or the surface state of the image receiving medium to stably form an image.

In this case, the undercoating liquid is superimposed so as to be positioned on a plane of the recording liquid where comes into contact with the image receiving medium so that the recording liquid is loaded on the undercoating liquid. A stream line of the undercoating liquid is straightened in the bead on the downstream side, while allowing an occurrence of sinuosity in the bead on the upstream side. The recording liquid is loaded on the undercoating liquid, which has been straightened, and transferred to the image receiving medium together with the straightened undercoating liquid layer. Accordingly, the stream line of the recording liquid does not become sinuous in the bead and thereafter, thereby improving the image quality without generating the distortion of an image.

Here, when a supply amount of the undercoating liquid is always set substantially constant without being subjected to modulation using the image signal or the undercoating liquid is supplied while setting the supply pressure thereof substantially constant, a flow of the undercoating liquid is stabilized to further improve the image quality. By providing a plurality of the recording liquid extruding ports in a direction of the width of the image receiving medium and forming the opening for extruding undercoating liquid so as to have a slot shape in the same direction, the undercoating liquid is extruded in the zonal or film-like form so that its flow is stabilized, and the recording liquid superimposed on the undercoating liquid can be stably transported, thus further improving the image quality.

The recording liquid extruding ports can be divided and arranged for each pixel. The recording liquid extruded from the respective extruding ports can be integrated in a direction along the array of the extruding ports to be extruded in the form of zonation and superimposed on the undercoating liquid. In this case, the extruding port for each pixel is formed in and facing to the slot-shaped opening, and the multiple flows of the recording liquid are integrated to be zonated in the slot-shaped opening.

The recording liquid and the undercoating liquid can be transported from the recording head to the final image receiving medium through the intermediate receiving medium. When using the intermediate image receiving medium in this manner, the coating liquid can be smoothly transported from the intermediate image receiving medium to the final image receiving medium by setting adhesion or cohesion of the undercoating liquid which comes into contact with the intermediate image receiving medium to be smaller than adhesion or cohesion of any other coating liquid in the layer.

With respect to a small interval between pixels, it is satisfactory to bias the adjacent extruding ports in the relative displacement direction of the image receiving medium. In this case, the image signal for each pixel is subjected to temporal compensation in accordance with this bias to prevent the distortion of the image. The application of the liquid is continuously carried out to enable the stable image formation by continuously extruding the coating liquid (the recording liquid and the undercoating liquid). For example, the clear liquid may be continuously extruded in a period during which an image is not formed. In such a case, the unnecessary recording liquid such as a clear liquid is removed and collected from a portion between the extruding ports the image receiving medium.

When the undercoating liquid is clear liquid which is or becomes substantially transparent after dried out, an image which is truthful to the image signal can be constantly recorded irrespective of presence/absence of the intermediate image receiving medium. When the undercoating liquid is liquid having an achromatic color which becomes substantially achromatic after dried out, an excellent image can be constantly recorded without being affected by a color of the final image receiving medium.

Moreover, according to the present invention, it is possible to obtain an image forming apparatus which is directly used for embodying the image forming method. The recording liquid extruding ports can be provided for respective pixels aligned in the width direction of the image receiving medium. Production of the recording head can be facilitated by providing and grouping the extruding ports for one pixel along a direction of movement of the image receiving medium. When the extruding ports for adjacent pixels are biased each other in a direction of movement of the image receiving medium, an interval between the adjacent extruding ports can be expanded to enhance the producibility of the recording head.

When the extruding ports for extruding the recording liquid are formed in the slot-shaped opening to become continuous in the width direction, the recording liquid can be superimposed in the zonal shape to be smoothly extruded. When the opening for extruding the undercoating liquid has a slot shape so that the undercoating liquid is zonally extruded therefrom, the undercoating liquid can be uniformly and smoothly supplied. The flow of the undercoating liquid can be smoothed to straighten the flow of the recording liquid superimposed on the undercoating liquid, thereby improving the image quality. The recording head can be constituted in accordance with the slot coating mode, the slide coating mode, and other coating modes. Additionally, means for removing and collecting the coating liquid in the middle of process can be provided and, in this case, further stable image formation is possible by continuously extruding the coating liquid.

When the image receiving medium is a sheet or film such as a recording paper, the flow of the coating liquid may be directly supplied to this medium by the recording head. Alternatively, the coating liquid can be transferred to the final image receiving medium such as paper through the intermediate image receiving medium. In this case, when the surface state of the intermediate image receiving medium is stabilized by the undercoating liquid to enable formation of an excellent image on the intermediate image receiving medium and the property of the undercoating liquid is appropriately set, the coating liquid (recording liquid) can be smoothly transported from the intermediate image receiving medium to the final image receiving medium. Therefore, the image formation having the further enhanced image quality becomes possible.

The extrusion amount controlling means can be formed by the extrusion amount control valve provided in the passage extending from the feed path for supplying coating liquid to the extruding port. In addition, this extrusion amount controlling means may control an amount of extrusion from each extruding port by a pump provided for each aperture for extruding coating liquid.

What is claimed is:

1. An image forming method for forming a n image on an image receiving medium with a recording liquid, comprising the steps of:

providing said recording liquid including an image forming liquid for finally forming the image and a clear liquid which is substantially transparent after dried out, a proportion of the image forming liquid and the clear liquid in the recording liquid being varied based on an image signal; and extruding said recording liquid from each of extruding ports aligned in a recording head to said image receiving medium as a continuous flow while said image receiving medium is moved relatively to the aligned extruding ports so that the recording liquid is continuously applied on sa id image receiving medium to form the image;

wherein a bead of said recording liquid is formed at a position where said recording liquid comes into contact with said image receiving medium while performing application of said recording liquid; and wherein an undercoating liquid is superimposed on said recording liquid so that the undercoating liquid is positioned on a plane to be brought into contact with the surface of said image receiving medium;

whereby a sinuosity of a stream line of said recording liquid in said bead is prevented while allowing a sinuosity of a stream line of said undercoating liquid in said bead.

2. The image forming method according to claim 1, wherein said undercoating liquid is not subjected to modulation using the image signal so that a supply amount of said undercoating liquid is set constant.

3. The image forming method according to claim 1, wherein said undercoating liquid is not subjected to modulation using the image signal so that a supply pressure thereof is set substantially constant for supplying said undercoating liquid.

4. The image forming method according to claim 1, wherein said recording liquid is extruded from plural extruding ports aligned in a direction substantially orthogonal to a relative movement direction of said image receiving medium; and wherein said undercoating liquid is extruded from a slot opening which is in parallel to a direction of arrangement of said plural extruding ports.

5. The image forming method according to claim 4, wherein said plural extruding ports are arranged in such a manner that each extruding port corresponds to respective pixels aligned in a direction substantially orthogonal to the relative movement direction of said image receiving medium; and wherein the recording liquids extruded from the aligned plural extruding ports are integrated in a direction of the arrangement of the plural extruding ports and zonally superimposed on said undercoating liquid.

6. The image forming method according to claim 1, wherein said recording liquid and said undercoating liquid are transferred to the image receiving medium to be held temporarily and are further transferred to a final image receiving medium.

7. The image forming method according to claim 6, wherein adhesion of said intermediate image receiving medium and said undercoating liquid which comes into contact therewith is set smaller than any of cohesion in said image forming liquid and said clear liquid, adhesion between said image forming liquid and said clear liquid, and adhesion of said final image receiving medium and coating liquid which comes into contact therewith.

8. The image forming method according to claim 6, wherein cohesion in said undercoating liquid which comes into contact with the surface of said intermediate image receiving medium is set smaller than any of cohesion in said image forming liquid and said clear liquid, adhesion between said image forming liquid and said clear liquid, and adhesion of said final image receiving medium and coating liquid which comes into contact therewith.

9. The image forming method according to claim 1, wherein the adjacent extruding ports are biased each other in a direction which is not orthogonal to a relative movement direction of said image receiving medium; and wherein the image signal for each pixel of the image is compensated for preventing the distortion of the image too be formed.

10. The image forming method according to claim 1, wherein said recording liquid and said undercoating liquid continue to be extruded from said extruding ports and said slot opening, respectively, even in a period for outputting the image signal during which no image is formed and said recording liquid extruded in the period for outputting the image signal during which no image is formed is removed and collected at a position between said extruding ports and said image receiving medium.

11. The image forming method according to claim 1, wherein said undercoating liquid is clear liquid which is substantially transparent after dried out.

12. The image forming method according to claim 1, wherein said undercoating liquid is a liquid which is substantially achromatic after dried out.

13. An image forming apparatus for forming an image on an image receiving medium with a recording liquid, comprising:

a recording head having an array of plural extruding ports aligned in a direction substantially orthogonal to a relative movement direction of the image receiving medium, the respective extruding ports extruding the recording liquid which is a combination of an image forming liquid and a clear liquid, the image forming liquid being for a finally forming the image and the clear liquid being substantially transparent after dried out, the recording liquid being transferred to the image receiving medium as a continuous flow while the image receiving medium is moved relatively to said aligned plural extruding ports;

an opening for extruding an undercoating liquid which is provided in parallel to a direction of arrangement of the array of said extruding ports in said recording head and superimposes the undercoating liquid on a plane of the recording liquid which comes into contact with the surface of said image receiving medium;

extrusion amount controlling means for controlling supply amounts of said image forming liquid and said clear liquid fed to each of said extruding ports; and a controller for controlling a mixing ratio of the image forming liquid and clear liquid in said recording liquid based on an image signal and determining a supply amount and supply timing of the image forming liquid and the clear liquid, the determined supply amount and supply timing being fed to said extrusion amount controlling means.

14. The image forming apparatus according to claim 13, wherein said plural extruding ports are arranged in such a manner that the respective extruding ports corresponds to each of pixels aligned in a direction of the width of said image receiving medium.

15. The image forming apparatus according to claim 13, wherein said plural extruding ports are divided to groups and extruding ports contained in the respective group are provided along a direction of movement of said image receiving medium to correspond to each of pixels aligned in a direction of the width of said image receiving medium.

16. The image forming apparatus according to claim 14, wherein said extruding ports corresponding to adjacent pixels are biased each other in a direction of movement of said image receiving medium.

17. The image forming apparatus according to claim 15, wherein said extruding ports corresponding to adjacent pixels are biased each other in a direction of movement of said image receiving medium.

18. The image forming apparatus according to claim 13, wherein said recording head has a slot-shaped opening arranged along a direction of the width of said image receiving medium, said slot-shaped opening combining said plural extruding ports associated with the respective pixels in the direction of the width of said image receiving medium and integrating the recording liquids extruded from the array of the plural extruding ports to be zonally extruded in the direction of the width of said image receiving medium.

19. The image forming apparatus according to claim 13, wherein said opening for extruding the undercoating liquid is formed into a slot shape for extruding the undercoating liquid in the zonal form which extends in a direction of the width of said image receiving medium.

20. The image forming apparatus according to claim 13, wherein said opening for extruding the undercoating liquid and said array of the plural extruding ports are formed on the top surface of said recording head in a relative displacement direction of said image receiving medium in order; and wherein said image receiving medium is transported in such a manner that the lower surface thereof is opposed to the top surface of said recording head.

21. The image forming apparatus according to claim 13, wherein said opening for extruding the undercoating liquid and said array of the plural extruding ports are formed on the lower surface of said recording head in a relative displacement direction of said image receiving medium in order; and wherein said image receiving medium is transported in such a manner that the top surface thereof is opposed to the lower surface of said recording head.

22. The image forming apparatus according to claim 13, wherein the top surface of said recording head has an sloped surface which is inclined so as to lower toward said image receiving medium and has a horizontal lower edge in the width direction being opposed to said image receiving medium in close proximity; wherein said extruding ports and said opening being formed on said sloped surface in a lowering direction of said sloped surface in order; and wherein said recording liquid extruded from each extruding port flows down on said sloped surface to be led to said image receiving medium in such a state as that the recording liquid is superimposed on the undercoating liquid extruded from said opening.

23. The image forming apparatus according to claim 13, further comprising coating liquid collecting means for removing and collecting at least said recording liquid in a portion between said recording head and said image receiving medium.

24. The image forming apparatus according to claim 13, wherein said image receiving medium is a final image receiving medium taking a form of a sheet.

25. The image forming apparatus according to claim 13, wherein said image receiving medium is an intermediate image receiving medium for temporarily holding the recording liquid and the undercoating liquid supplied from said recording head and for further transferring the recording liquid and the undercoating liquid to final image receiving medium.

26. The image forming apparatus according to claim 13, wherein said extrusion amount controlling means is formed by a control valve provided in a passage extending from a feed path for supplying coating liquid and the respective extruding ports.

27. The image forming apparatus according to claim 13, wherein said extrusion amount controlling means is formed by a pump for varying a supply amount of the coating liquid.

* * * * *